US005249534A

United States Patent [19]

Sacks

[11] Patent Number: 5,249,534

[45] Date of Patent: Oct. 5, 1993

[54] PROTECTIVE COVER

[75] Inventor: Michael Sacks, Manchester, England

[73] Assignee: Dowty Armourshield Limited, Manchester, England

[21] Appl. No.: 818,378

[22] Filed: Jan. 9, 1992

[30] Foreign Application Priority Data

Jan. 11, 1991 [GB] United Kingdom ..... 9100663

[51] Int. Cl.[5] ..... E05G 1/00

[52] U.S. Cl. ..... 109/24; 52/DIG. 12; 86/50; 102/303; 109/27; 109/49.5; 109/62; 109/79; 428/54; 428/474.4

[58] Field of Search ..... 109/49.5, 15, 24, 26, 109/27, 36, 62, 63.5, 79; 52/DIG. 12; 428/54, 474.4; 102/303; 86/50

[56] References Cited

U.S. PATENT DOCUMENTS

| | | | |
|---|---|---|---|
| 547,172 | 10/1895 | Maguire | 102/303 |
| 3,491,847 | 1/1970 | Abbott | 102/303 X |
| 3,648,613 | 3/1972 | Cunn | 109/49.5 X |
| 3,801,416 | 4/1974 | Gulbierz | 109/49.5 |
| 3,814,016 | 6/1974 | Leach et al. | 102/303 |
| 3,924,038 | 12/1975 | McArdle et al. | 109/49.5 X |
| 4,375,869 | 3/1983 | Hatch | 109/49.5 X |
| 4,389,947 | 6/1983 | King et al. | 109/49.5 X |
| 4,510,200 | 4/1985 | Samowich | 109/49.5 X |
| 4,546,863 | 10/1985 | Kaufman | 109/49.5 X |
| 4,633,899 | 1/1987 | Lord | 52/DIG. 12 X |
| 4,686,911 | 8/1987 | Phillips | 109/27 X |
| 4,804,877 | 2/1989 | Harwood | 109/49.5 X |
| 5,044,252 | 9/1991 | Gamadi et al. | 86/50 |

FOREIGN PATENT DOCUMENTS

| | | | |
|---|---|---|---|
| 31547 | 10/1977 | Japan | 52/DIG. 12 |
| 518338 | 2/1940 | United Kingdom | 109/49.5 |

*Primary Examiner*—Lloyd A. Gall

*Attorney, Agent, or Firm*—Young & Thompson

[57] ABSTRACT

A cover for use with a container (1) comprises one or more layers (11, 12, 15) of high tensile strength, high stretch resistance flexible material which are capable of resisting penetration by bomb blast and fragmentation and which are adapted so that the cover can expand and absorb and/or channel the blast from within the container (1). For this purpose, the layers of flexible material are interconnected by hook-and-eye type fabric fasteners, which can give or release under load to allow controlled expansion of the cover in the event of an explosion. The container may be the type used to carry cargo or luggage on an aircraft and placing the cover (11, 12, 15) about the container a bomb secreted in the luggage or cargo will be prevented from destroying the aircraft.

10 Claims, 4 Drawing Sheets

PROTECTIVE COVER

Figure 1:
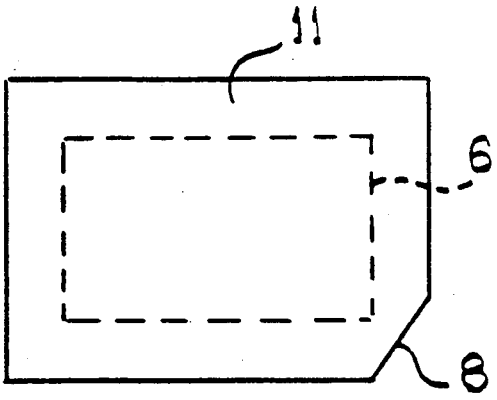

This invention relates to means for containing or reducing the effects of explosions, especially bomb blast and fragmentation, in vehicles such as aircraft, where weight is an important consideration.

Passenger airplanes are vulnerable to terrorist attack by bombs smuggled on board in passengers' luggage and goods in transit. The luggage is stowed in containers on the airplane each comprising a substantially rectangular framework clad with aluminium panels on all sides except for one or two sides which have openings for the loading or unloading of luggage with curtains to close these openings against the weather. These containers are packed, usually two abreast, in the luggage hold of the airplane beneath the passenger cabin. The containers themselves provide no protection against bomb blast, and the close proximity of critically important structures and systems of the airplane make it vulnerable to bomb damage.

An object of the present invention is to provide means to protect against the effects of an explosion in such luggage containers in airplanes.

According to one aspect, the invention consists in providing a cover for a container comprising one or more layers of high tensile strength, high stretch resistance flexible material which are capable of resisting penetration by bomb blast and fragmentation and which are adapted so that the cover can expand and absorb and/or channel the blast from an explosion within the container.

Suitable material may comprise an aramid material such as the closely woven aramid fabric supplied either by Du Pont International under their registered trade mark "Kevlar" or by Akzo under their trade mark "Twaron", or polyethylene material such as the woven and non-woven fabric supplied by Allied-Signal under their trade marks "Spectra" and "Spectrashield" or by DSM under their trade mark "Dyneema". A mixture of an aramid material and a polyethylene material as identified above may also be used.

In the case of a container having a base standing on a floor, the cover is adapted to cover the top and all sides of the container. Further, the container is preferably shaped to match the shape of the container so as to be a close fit over it.

Preferably, the cover comprises a plurality of separate panels of said material which are shaped to match respective side walls and the top of the container and are connected together with fasteners, such as hook-and-eye type fabric fasteners, which can give or release under load to allow controlled expansion of the cover in the event of an explosion.

Preferably, certain portions of said panels where they meet at their edges or in the region of openings in the container or other more vulnerable portions of the container are overlapped to provide additional protection. Alternatively or additionally, a separate overlapping strip may be provided between the edges of adjacent panels where they meet. This may take the form of a complete cover around continuous edges of the container such as the upper horizontal edges of a rectangular container.

In the case of a rectangular container, the cover may comprise a panel of said material in the form of a strip across the top of the container and hanging down over a pair of opposite side walls. A second panel in the form of a strip may be placed over the first panel across the top of the container and hang down over the other pair of opposite side walls, the two panels being connected together at the edges of the container. A third panel in the form of a strip may be wound around the other two panels and the side walls of the container a number of times and have its ends connected together.

Alternatively, the cover may comprise a similar first panel with one or more panels in the form of strips around the sides of the container overlapping the hanging ends of the first panel.

A cover may be adapted so that one or more panels of said material can preferably separate from the others in the event of an explosion so as to release the blast in a particular direction. This is especially applicable to containers in an airplane. For example, the cover and possibly the container itself may be adapted so that the blast escapes towards an adjacent safe space or a wall of the airplane, it being preferred in the latter case for the blast to produce a discrete hole in the wall of the airplane through which it escapes rather than causing unpredictable damage, possibly to vital structure or equipment.

Said material of the cover may be formed with folds in certain regions to accommodate outwards expansion of the cover as a result of an explosion.

The separate panels of a cover may be assembled around a container or may be pre-assembled ready to be set in place over a container. If required, the cover can be made self-supporting by incorporating therein relatively rigid components such as polycarbonate sheet material adjacent to the inner or outer or both surfaces of the panels.

Further, the cover may incorporate fire resistant material which may take the form of a layer on both sides thereof of said high tensile strength, high stretch resistance flexible material.

A cover may be adapted to go over two or more containers, for example a whole array of stacked containers.

If a container is not used to stow goods or luggage then a cover according to the invention can be provided over the goods or luggage directly.

According to another aspect, the invention consists in protecting an aircraft against the effect of explosion in goods or luggage stowed in the aircraft by providing a screen between said goods and aircraft structure to be protected, the screen comprising one or more layers of high tensile strength, high stretch resistance flexible material which are capable of resisting penetration by bomb blast and fragmentation.

In the case of an aircraft with a stowage space beneath a passenger cabin, the screen can be provided in the stowage space between the goods or luggage and the floor of the passenger cabin.

In the case of an aircraft in which goods or luggage are stowed in containers stacked in the stowage space back to back, the screen can be provided between rows of said containers.

Figure 2:
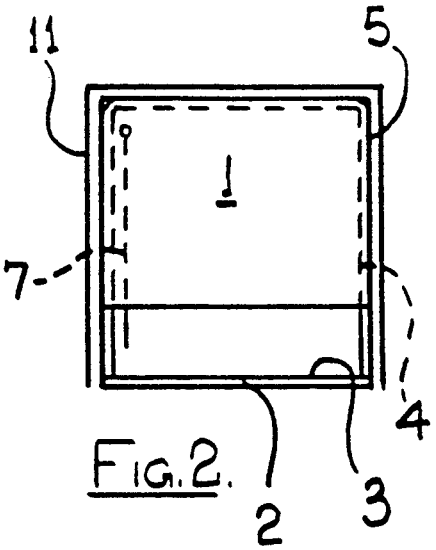
Figure 3:
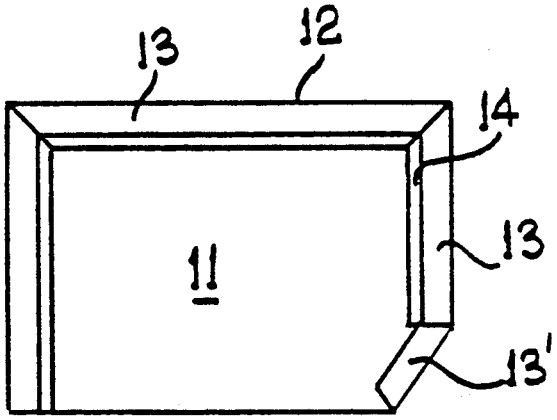
Figure 5:
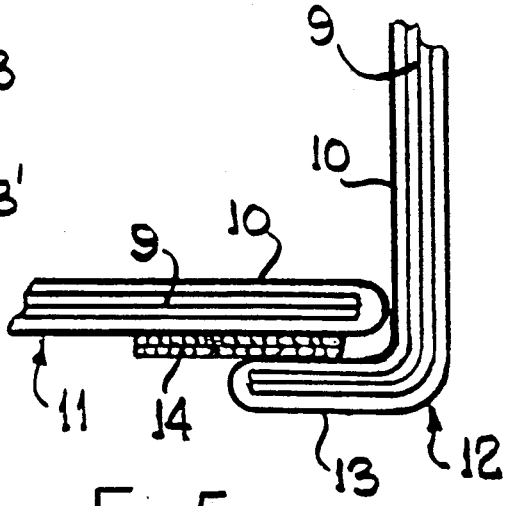
Figure 4:
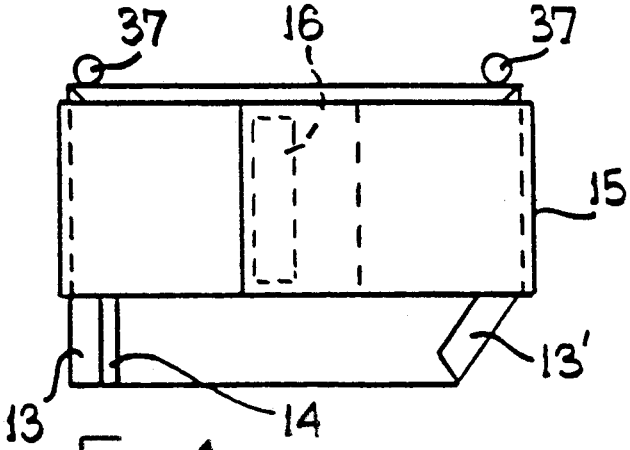
Figure 6:
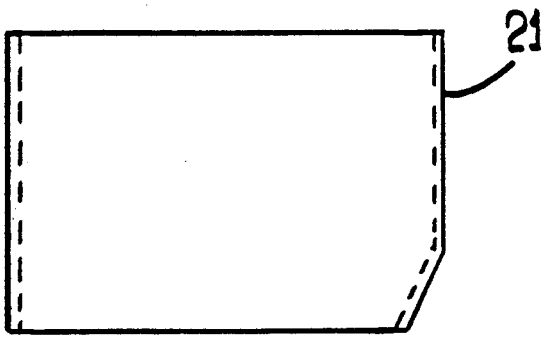
Figure 7:
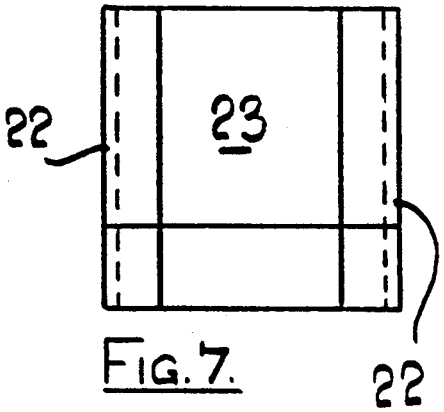
Figure 8:
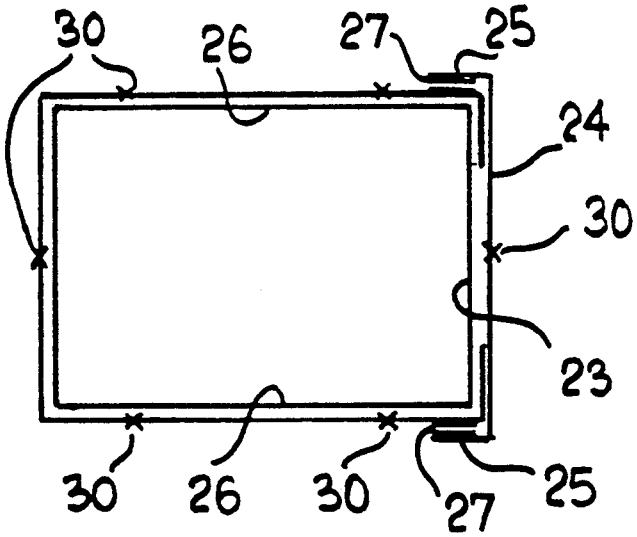
Figure 9:
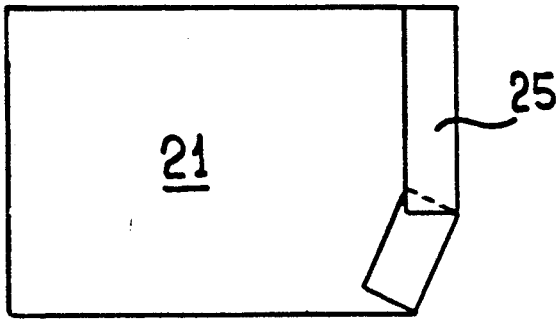
Figure 10:
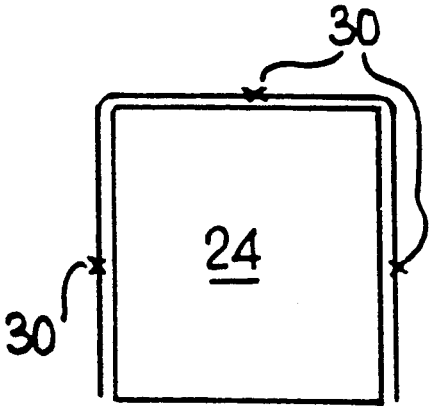
Figure 11:
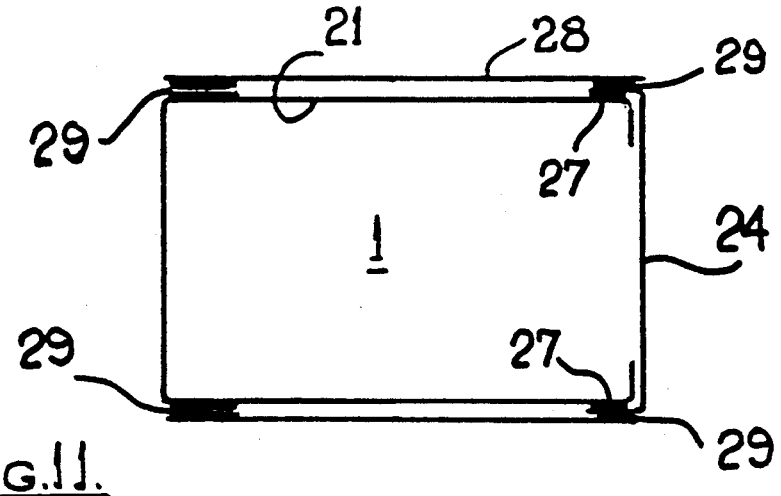
Figure 12:
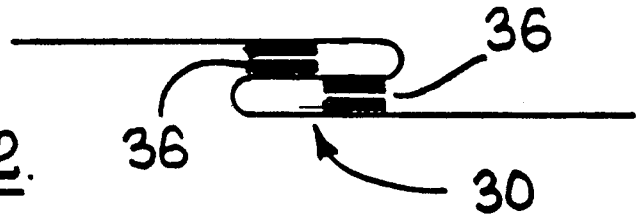
Figure 13:
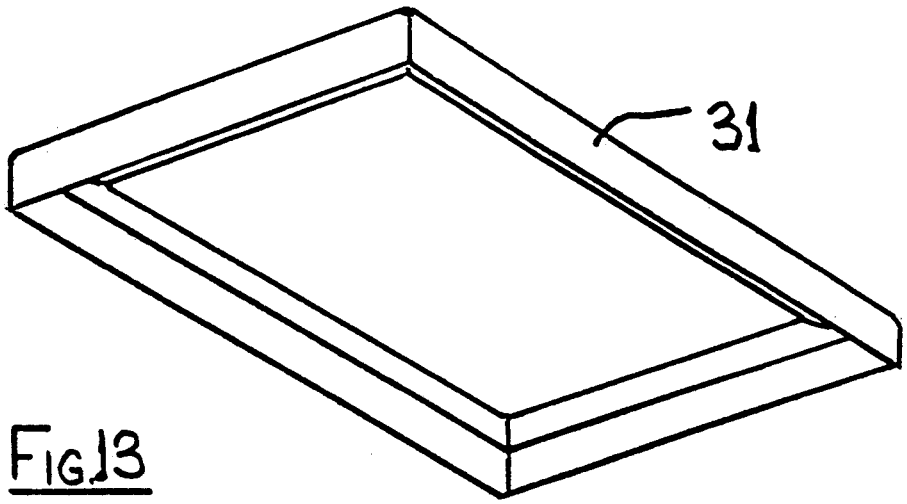
Figure 14:
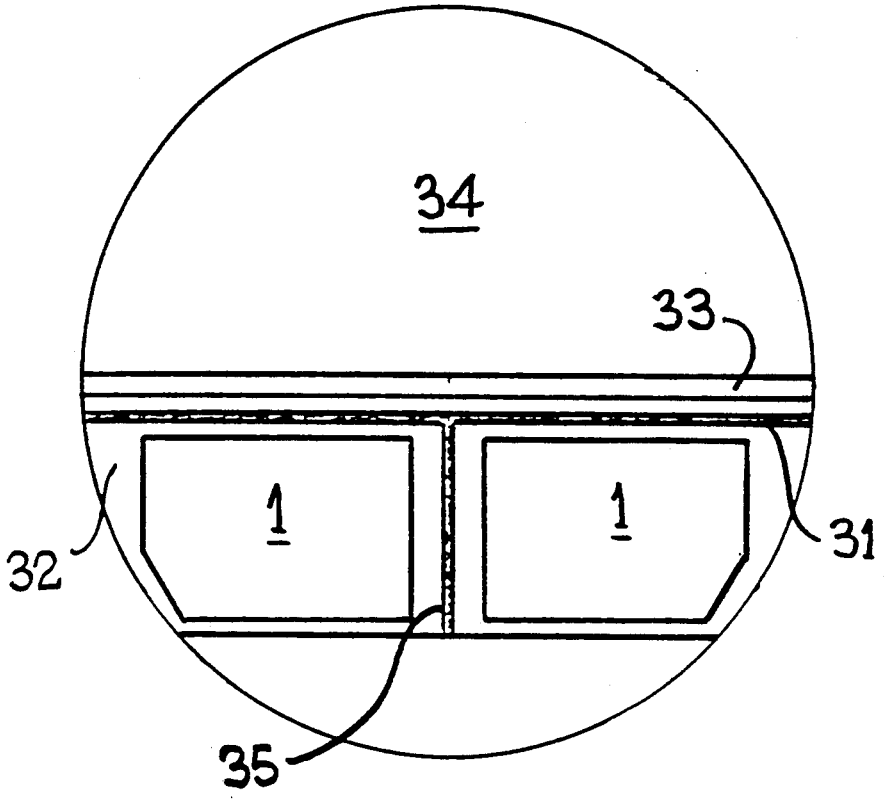
Figure 15:
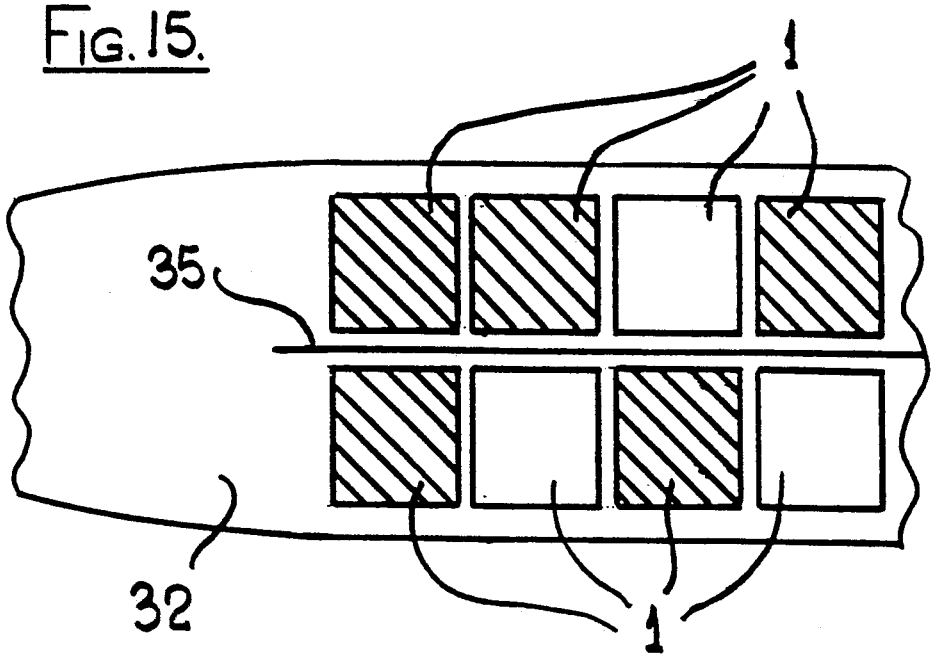

The invention will now be described by way of example with reference to the accompanying drawings in which:

FIG. 1 is a side elevation of a partly assembled cover according to a first embodiment of the invention, FIG. 2 is an end elevation of the part cover of FIG. 1, FIG. 3 is a side elevation of the part cover of FIG. 1 at an intermediate stage of assembly, FIG. 4 is a side elevation of the part cover of FIG. 3 at the final stage of assembly, FIG. 5 is a section through two overlapped panels fastened together at a corner of the cover of FIG. 3, FIG. 6 is a side elevation of a partly assembled cover according to a second embodiment of the invention, FIG. 7 is an end elevation of the part cover of FIG. 6, FIG. 8 is a plan view of the part cover of FIG. 6 at an intermediate stage of assembly, FIG. 9 is a side elevation of the part cover of FIG. 8, FIG. 10 is an end elevation of the part cover of FIG. 9 at the final stage of assembly, FIG. 11 is a horizontal section of the cover of FIG. 10, FIG. 12 is a section through a gather in the cover of FIGS. 8 and 9, FIG. 13 is a perspective view of a protective collar for use in the cover of FIGS. 4 or 10, FIG. 14 is a cross-section through an airplane fuselage showing the use of protective screens according to the invention, and FIG. 15 is a plan view of the stowage space of the airplane of FIG. 14.

FIGS. 1 to 5 illustrate a cover according to one embodiment of the invention in which three separate strip-shaped panels composed of multiple layers of "Kevlar" woven fabric are assembled around an airplane luggage container so as to protect against the effect of an explosion within the container. The container 1 consists of a rigid base 2 with a floor 3 to support luggage, a frame 4 of tubular aluminium that extends along the edges of the container, and a number of aluminium panels 5 that are riveted to the frame 4 to close the sides of the container except for one or an opposite pair of sides which are formed with an opening 6 to load or unload luggage. A suspended plastic curtain 7 is provided to close each opening 6 against the weather. The container is generally rectangular in shape but has a portion 8 at one end adjacent to the base 2 which is undercut to conform to the shape of the outer wall of an airplane.

The three panels of "Kevlar" laminations each comprise eighteen layers 9 of "Kevlar" woven fabric which are stitched together and enclosed in an outer cover 10 of fire resistant fabric such as silicone coated glass cloth. In alternative embodiments of the invention, 7–30 layers of "Kevlar" may be used, although 12–18 layers are preferred.

A first panel 11 is laid across the top of the container and hangs down over a first pair of opposite sides of the container, and is shaped to cover the top and these sides completely, as shown in FIGS. 1 and 2. A second panel 12 is laid across the top of the container over the first panel 11, and hangs down over the second pair of opposite sides of the container, covering the top and these sides completely and also being folded over at its edges onto the outside of the first panel as shown in FIG. 3. These folded edges 13 of the second panel are attached to the first panel along their whole length by hook-and-eye type fabric fasteners 14 such as that supplied under the trade mark "Velcro". Over most of their length, these fasteners 14 are wider than the actual overlap between the first and second panels 11, 12, as shown in FIG. 5, so as to ensure more secure fastening. However, those fasteners 14 along the folded edges 13′ of the second panel adjacent to the undercut portion 8 of the container are narrower to give a less secure fastening for reasons that will be explained later. Finally, a third panel 15 is wound three times around the sides of the container over the first and second panels and the free end of the panel attached to itself by a full width "Velcro" fastening 16. This third panel 15 is just wide enough to cover the vertical portion of the end wall of the container which has the undercut portion 8.

A cover comprising these three panels has been tested by setting off an explosive charge inside the container and it has been found that the explosive blast and fragments from luggage within the container have been successfully contained. The cover lifts up slightly and the lower portions of the panels 11 and 12 unhindered by the third wound panel 15 open outwards pulling the "Velcro" fasteners apart to release and dissipate the blast. Because of the different width of the "Velcro" fasteners at the two ends of the cover, the folded edges 13′ are pulled free of their fasteners first, and thus the blast escapes at least initially at this undercut end 8. In this way, the blast is contained and directed at the wall of the airplane so that any damage is limited to this locality. If required, the undercut portion 8 of the container may be weakened so as to further ensure that the blast escapes in this locality. Additionally, the walls of the airplane in this locality may be adapted to allow safe blow-out.

In alternative embodiments of the invention, the cover of FIGS. 1 to 4 may be adapted by varying the number of turns of the third panel 15 around the container. Providing there is at least one turn, each side and the top of the container is covered by two panels. However, multiple turns of the third panel will serve to hold the other two panels more firmly in place.

In the case of a container without the undercut portion 8, the cover can be made the same except that the first panel has square corners at each end to match the fully rectangular shape of the container. If desired, the lower portion of the end wall of the container where the panels 11 and 12 are unfastened, is weakened.

In another embodiment of the invention, the cover may comprise just the first two panels 11, 12 shown in FIGS. 1 to 3. It has been found that such a cover still serves to dissipate an explosion within the container, the side portions of the panels tending to pull apart from their "Velcro" fasteners 14 and lift up, partly absorbing the blast in the process.

FIGS. 6 to 11 illustrate a cover according to another embodiment of the invention which again comprises three separate strip-shaped panels composed of layers of "Kevlar". The panels are shown assembled around an airplane luggage container 1 similar to that of FIGS. 1 to 4. A first panel 21 is wrapped around three sides of the container 1 and its free ends 22 laid against the uncovered end 23 of the container as shown in FIGS. 6 and 7. This first panel extends the full height of the container. A second panel 24 covers the end 23 of the container over its full height, and its free ends 25 are turned onto the adjacent sides 26 of the container and are fastened to the first panel 21 by "Velcro" fasteners 27 over the full height as shown in FIG. 8 and 9. A third panel 28 is laid across the top of the container and hangs down over the sides 26 of the container and the corresponding portions of the first and second panels, covering the full length of the top and these sides, as shown in FIGS. 10 and 11. "Velcro" fasteners 29 fasten the side portions of the third panel to the first and second panels along their outer edges, as shown in FIG. 11.

A cover such as illustrated in FIGS. 6 to 11 is adapted to allow a preferential release of a blast within the container by the fasteners 27 and 29 between the panels pulling free and releasing the second panel at that respective end. For example, these fasteners 27 and 29 at the one end of the cover may be narrower than the fasteners 29 at the other end as shown in FIG. 11, so that the former fasteners pull apart more easily.

The cover of FIGS. 6 to 11 may be adapted to accommodate expansion in the event of a blast by providing gathers or folds 30 across the panels at selected locations, as indicated by the crosses in FIGS. 8 and 10. For example, vertical gathers 30 in the panels 21, 24 (FIG. 8) allow the panel to increase in length and move outwards as the gathers are forcibly unfolded by a blast. Similarly, horizontal gathers 30 in the panel 28 (FIG. 10) allows this to increase in length. A section through a gather 30 is shown in FIG. 12 comprising two folds of the panel which are held together by "Velcro" fasteners 36 running the length of the gather. Thus the tension produced in the panel by a blast has to be great enough to pull the fasteners apart before the gather unfolds. More than two folds can be formed in a gather if required.

In an alternative embodiment of the invention, the third panel 28 instead of lying outside of the first and second panels may be placed in position first with the first and second panels wrapped around the outside and being fastened by "Velcro" fasteners to the third panel.

In yet another embodiment of the invention, a rectangular shaped collar 31 of L-section composed of "Kevlar" laminations, as shown in FIG. 13, may be placed around the top corner of the container to provide additional blast protection and preferably to overlap the edges of inner panels at these corners and hold them together.

As described so far, the illustrated covers are each assembled around a container. However, in alternative embodiments of the invention the cover may be preassembled and placed in position over a container. For example, the cover may be provided with attachment means 37 (FIG. 4) that allows it to be raised and lowered by a hoist for lifting onto or off of a container. The attachment means may take the form of loops or rings secured to the top of the cover at its corners and possibly at intermediate points along its upper edges for engagement by the hooks of a hoist.

In yet other alternative embodiments of the invention, the cover may incorporate sheets of impact resistant material such as polycarbonate sheet to give additional penetration resistance. Such sheets would preferably be located adjacent to the outer surfaces of the panels of "Kevlar" laminations, and would be of benefit in giving a more rigid shape to the cover that would accommodate its use as a pre-formed cover as described above. In alternative embodiments, the polycarbonate sheets could be located adjacent to the inner surfaces of the panels or adjacent to both the inner and outer surfaces. The polycarbonate sheets are typically 1 m.m. thick but could be 0.75 to 3.0 m.m. thick.

An alternative embodiment of the invention is illustrated in FIGS. 14 and 15 in which a screen 31 comprising multiple layers of "Kevlar" woven fabric is suspended generally horizontally above the luggage containers 1 in the stowage space 32 of an airplane so as to protect the floor structure 33 of the passenger cabin 34 above the stowage space. Additionally, where the containers are arranged in rows along the length of the airplane fuselage, a screen 35 comprising multiple layers of "Kevlar" woven fabric may be suspended generally vertically between adjacent rows of containers so as to contain the blast to particular parts of the stowage space.

Also, the individual containers 1 may each be provided with a cover such as described above with reference to FIGS. 1 to 13. Alternatively, alternate containers 1 along a row may be provided with a cover so that the sides of these covers serve to absorb the effect of a blast in a container between them having no cover. Further, where there are two rows of containers, the containers in each row having covers are staggered by one container so that an intermediate container having no cover is surrounded on three sides by containers having covers, such as shown in FIG. 15, where the containers with covers are shown hatched. Additionally, all containers at the ends of the rows may be provided with covers to protect adjacent open spaces.

I claim:

1. A cover for use with a container comprising one or more layers of high tensile strength, high stretch resistance flexible material which are capable of resisting penetration by bomb blast and fragmentation and which are adapted so that the cover can expand and absorb the blast from an explosion within the container, said cover comprising a plurality of separate panels of said material which are shaped to overly respective side walls and the top of the container and are connected together with fasteners which progressively peel apart under load from the blast to allow controlled expansion of the cover in the event of an explosion.

2. A cover as claimed in claim 1 wherein the cover is adapted to cover the top and all sides of the container.

3. A cover as claimed in claim 1 wherein the cover is shaped to substantially match the shape of the container so as to be a close fit over it.

4. A cover as claimed in claim 1 wherein the layers are overlapped at portions to provide additional protection.

5. A cover as claimed in claim 1 wherein a discrete overlapping strip is provided over adjacent edge portions of the material.

6. A cover as claimed in claim 1 adapted for use with a rectangular container wherein the cover comprises a first panel of said material in the form of a strip across the top of the container and hanging down over a pair of opposite sides wall and a second panel in the form of a strip placed over the first panel across the top of the container and hanging down over the other pair of opposite side walls, the two panels being connected together at the edges of the container.

7. A cover as claimed in claim 6 comprising a third panel in the form of a strip wound, at least once, around the other two panels and the side walls of the container.

8. A cover as claimed in claim 1 adapted such that one or more panels of said material separate from other said panels in an explosion.

9. A cover as claimed in claim 1 wherein the cover is formed with folds in certain regions to accommodate outwards expansion of the cover as a result of an explosion.

10. A cover as claimed in claim 1 wherein said fasteners are strips of interengaging hook-and-eye type fabric disposed along and releasably interconnecting adjacent edges of said panels.

* * * * *